US011158947B2

(12) United States Patent
Delaveaud et al.

(10) Patent No.: US 11,158,947 B2
(45) Date of Patent: Oct. 26, 2021

(54) MONOPOLE WIRE-PLATE ANTENNA

(71) Applicant: COMMISSARIAT A L'ENERGIE ATOMIQUE ET AUX ENERGIES ALTERNATIVES, Paris (FR)

(72) Inventors: Christophe Delaveaud, Grenoble (FR); Lotfi Batel, Grenoble (FR); Jean-Francois Pintos, Grenoble (FR)

(73) Assignee: COMMISSARIAT A L'ENERGIE ATOMIQUE ET AUX ENERGIES ALTERNATIVES, Paris (FR)

( * ) Notice: Subject to any disclaimer, the term of this patent is extended or adjusted under 35 U.S.C. 154(b) by 46 days.

(21) Appl. No.: 16/718,521

(22) Filed: Dec. 18, 2019

(65) Prior Publication Data

US 2020/0203838 A1 Jun. 25, 2020

(30) Foreign Application Priority Data

Dec. 18, 2018 (FR) ..... 18 73167

(51) Int. Cl.
*H01Q 1/36* (2006.01)
*H01Q 9/04* (2006.01)
*H01Q 1/48* (2006.01)

(52) U.S. Cl.
CPC ..... *H01Q 9/0421* (2013.01); *H01Q 1/48* (2013.01)

(58) Field of Classification Search
CPC ..... H01Q 9/0421; H01Q 1/48; H01Q 9/36
USPC ..... 343/700 R
See application file for complete search history.

(56) References Cited

U.S. PATENT DOCUMENTS 4,695,788 A * 9/1987 Marshall ..... G01R 31/54 324/527
6,300,908 B1 * 10/2001 Jecko ..... H01Q 9/0407 343/700 MS
7,129,899 B2 * 10/2006 Jecko ..... H01Q 9/0421 343/702
10,205,326 B2 * 2/2019 Corum ..... H02J 50/00
10,547,115 B2 * 1/2020 Jouanlanne ..... H01Q 13/103
2004/0183735 A1 * 9/2004 Jecko ..... H01Q 5/357 343/725
2017/0070060 A1 * 3/2017 Corum ..... H02J 3/00
2017/0352962 A1 * 12/2017 Jouanlanne ..... H01Q 9/0421
2018/0261904 A1 * 9/2018 Corum ..... H02J 50/005

OTHER PUBLICATIONS

French Preliminary Search Report dated Sep. 30, 2019 in French Application 18 73167 filed Dec. 18, 2018 (with English Translation of Categories of Cited Documents and Written Opinion), 10 pages.

(Continued)

*Primary Examiner* — Jean B Jeanglaude
(74) *Attorney, Agent, or Firm* — Oblon, McClelland, Maier & Neustadt, L.L.P.

(57) ABSTRACT

This antenna includes: a ground plane; a capacitive roof, parallel with the ground plane; a supply probe, which is electrically isolated from the ground plane and runs between the ground plane and the capacitive roof so as to supply the capacitive roof with electricity, the supply probe being intended to be connected to a transmission line; a set of shorting wires, which are arranged in parallel around the supply probe such that each shorting wire electrically connects the capacitive roof to the ground plane, each shorting wire being coated with a magneto-dielectric material.

13 Claims, 3 Drawing Sheets

(56) References Cited

OTHER PUBLICATIONS

Batel, L. et al., "Design of a monopolar wire-plate antenna loaded with magneto-dielectric material," 12$^{th}$ European Conference on Antennas and Propagation (EUCAP 2018), Apr. 13, 2018, 5 pages.
Delaveaud, C. et al., "New kind of microstrip antenna: the monopolar wire-patch antenna," Electronics Letters, vol. 30, No. 1, Jan. 6, 1994, 2 pages.
Liu, J. et al., "Design and Analysis of a Low-Profile and Broadband Microstrip Monopolar Patch Antenna," IEEE Transactions on Antennas and Propagation, vol. 61, No. 1, Jan. 2013, pp. 11-18.
Lau, K. L. et al., "A Wide-Band Monopolar Wire-Patch Antenna for Indoor Base Station Applications", IEEE Antennas and Wireless Propagation Letters, vol. 4, No. 1, Jun. 20, 2005, pp. 155-157.

* cited by examiner

MONOPOLE WIRE-PLATE ANTENNA

TECHNICAL FIELD

The invention relates to the technical field of monopole wire-plate antennas. The invention is notably applicable to the Internet of Things (IoT), radiofrequency identification (RFID), communication for sensor networks, machine-to-machine (M2M) communication and communication in the fields of aeronautics and space.

PRIOR ART

A monopole wire-plate antenna known from the prior art, notably from document L. Batel et al., "*Design of a monopolar wire-plate antenna loaded with magneto-dielectric material*", EuCAP (European Conference on Antennas and Propagation), April 2018, includes:

- a ground plane;
- a capacitive roof, parallel with the ground plane;
- a supply probe, which is electrically isolated from the ground plane and runs between the ground plane and the capacitive roof so as to supply the capacitive roof with electricity, the supply probe being intended to be connected to a transmission line;
- a single shorting wire, which is arranged at a distance from the supply probe such that the shorting wire electrically connects the capacitive roof to the ground plane, the shorting wire being coated with a magneto-dielectric material.

Such an antenna of the prior art, by virtue of the magneto-dielectric material coating the shorting wire, may have dimensions that are about 15% smaller in comparison with an architecture without magneto-dielectric material while providing similar performance.

A monopole wire-plate antenna architecture that allows the miniaturization of the antenna to be improved for the same amount of magneto-dielectric material is sought.

DISCLOSURE OF THE INVENTION

To this end, the subject of the invention is a monopole wire-plate antenna, including:

- a ground plane;
- a capacitive roof;
- a supply probe, which is electrically isolated from the ground plane and runs between the ground plane and the capacitive roof so as to supply the capacitive roof with electricity, the supply probe being intended to be connected to a transmission line;
- a set of shorting wires, which are arranged in parallel around the supply probe such that each shorting wire electrically connects the capacitive roof to the ground plane, each shorting wire being coated with a magneto-dielectric material.

Thus, such an antenna according to the invention makes it possible to improve the miniaturization of the antenna for the same amount of magneto-dielectric material by arranging a plurality of shorting wires in parallel, each of which is coated with a magneto-dielectric material.

It is known that arranging a plurality of wires in parallel is equivalent to the presence of a single wire having an equivalent radius that is larger than the individual radius of the wires in parallel, as stated in document E. A. Wolff "*Antenna analysis*", Wiley, 1966, or in document C. Harrison et al., "*Folded dipoles and loops*", IEEE Transactions on Antennas and Propagation, vol. 9, issue 2, pp. 171-187, 1961.

However, the inventors have observed that for the same amount of magneto-dielectric material, arranging a set of shorting wires in parallel, each coated with a magneto-dielectric material, makes it possible to decrease the resonant frequency of the antenna towards the low frequencies by more than 30% in comparison with an equivalent single shorting wire coated with a magneto-dielectric material. In other words, arranging a set of shorting wires in parallel, each coated with a magneto-dielectric material, allows better interaction between the antenna and the magneto-dielectric material, and hence more efficient miniaturization of the antenna loaded with magneto-dielectric material. For an architecture with a single shorting wire, it is estimated that a volume of magneto-dielectric material 20 times greater would be needed to decrease the resonant frequency of the antenna towards the low frequencies by more than 30%, which would result in substantial bulk, additional losses (due to the amount of additional material) and increased antenna weight.

Definitions

The term "capacitive roof" is understood to mean a generally planar, electrically conductive, surface which may for example be rectangular or circular in shape and produce a capacitive effect with the ground plane. The term "planar" is understood to mean within the typical tolerances of the experimental conditions under which the capacitive roof is formed rather than perfect planarity in the geometric sense of the term.

The term "supply probe" is understood to mean a probe for exciting the antenna, which is conventionally connected to a central core of a coaxial guide and electrically connected to the capacitive roof.

The term "transmission line" is understood to mean an element allowing the guided propagation of electromagnetic waves (e.g. in the radiofrequency range), the transmission line possibly being a coaxial supply cable or another waveguide.

The term "coated" is understood to mean that the magneto-dielectric material covers (makes contact with) the entire free surface of the corresponding shorting wire.

The term "magneto-dielectric material" is understood to mean a material exhibiting, at the operating wavelength of the antenna, a relative permittivity ($\varepsilon_r$) that is strictly higher than one and a relative permeability ($\mu_r$) that is strictly higher than one.

The antenna according to the invention may include one or more of the following features.

According to one feature of the invention, the supply probe is arranged at the centre of the ground plane and the set of shorting wires includes at least one pair of shorting wires that is arranged around the supply probe with central symmetry.

Thus, one advantage afforded is that of obtaining symmetry for the radiation of the antenna and of decreasing cross-polarization.

According to one feature of the invention, the set of shorting wires includes a number of shorting wires chosen such that, for a given amount of magneto-dielectric material, the capacitive roof and the supply probe each have a maximum characteristic dimension such that the antenna is contained within a sphere with an electrical radius that is smaller than or equal to $\lambda/2\pi$, where $\lambda$ is the operating wavelength of the antenna.

Thus, one advantage afforded is that of obtaining a miniature antenna. The term "miniature" is understood to mean that the antenna is contained within a sphere (referred to as Wheeler's sphere) with an electrical radius that is smaller than or equal to $\lambda/2\pi$. For example, in the case of a circular capacitive roof, the radius of Wheeler's sphere is the hypotenuse of a right-angled triangle with the right angle being formed by the radius of the capacitive roof and the height of the antenna, and which must be smaller than or equal to $\lambda/2\pi$.

According to one feature of the invention, the supply probe is coated with the magneto-dielectric material.

Thus, one advantage afforded is that of increasing the amount of magneto-dielectric material in the antenna and thereby the efficiency of loading the antenna with magneto-dielectric material so as to decrease its dimensions.

According to one feature of the invention, the antenna includes a magneto-dielectric layer extending between the ground plane and the capacitive roof so as to coat each shorting wire and the supply probe.

Thus, one advantage afforded is that of simplifying the production of the antenna.

According to one feature of the invention, the capacitive roof and the ground plane define a cylindrical volume, and the magneto-dielectric layer extends into all or part of the cylindrical volume.

The term "cylindrical" refers to the shape of a cylinder of which the surface is generated by a family of lines in the same direction (generatrices). By way of examples, the cross section of the cylinder (i.e. the intersection with the surface by a plane perpendicular to the direction of the generatrices) may be circular or quadrangular (e.g. rectangular).

According to one feature of the invention, the magneto-dielectric material is chosen such that the relationship $\mu_r>\varepsilon_r>1$ is satisfied at the operating wavelength of the antenna, where:

$\mu_r$ is the relative permeability of the magneto-dielectric material;

$\varepsilon_r$ is the relative permittivity of the magneto-dielectric material.

Thus, one advantage afforded by the magneto-dielectric material is that of contributing to the miniaturization of the antenna by decreasing the guided wavelength ($\lambda_g$) in the material according to the formula below:

$$\lambda_g = \frac{\lambda}{\sqrt{\varepsilon_r \mu_r}}$$

where $\lambda$ is the operating wavelength of the antenna.

To favour the miniaturization of the antenna, the highest possible product of $\varepsilon_r$, $\mu_r$ is sought.

More specifically, because $\mu_r>\varepsilon_r>1$, a high $\mu_r$ can be favoured over a high $\varepsilon_r$, since an overly high $\varepsilon_r$ generally leads to a high concentration of electromagnetic field in the antenna, with potential impedance-matching problems, thus resulting in losses in the transfer of electromagnetic (e.g. radiofrequency) power through free space. Additionally, the monopole wire-plate antenna interacts efficiently with the magnetic properties of the material via the shorting wires, which provides it with specific near-field magnetic behaviour.

According to one feature of the invention, the magneto-dielectric material is chosen from $Ni_{0.5}Zn_{0.3}Co_{0.2}In_{0.075}Fe_{1.925}O_4$, $Ni_{0.76}Mn_{0.24-x}Co_xFe_2O_4$ where x is between 0 and 0.04, and $Ni_{0.61}Zn_{0.35}Co_{0.04}Fe_{1.98}O_4$.

Thus, one advantage afforded by such materials is that of satisfying $\mu_r>\varepsilon_r>1$.

According to one feature of the invention, the shorting wires are separated from the supply probe by a distance chosen to match the input impedance of the antenna 30 to 50 ohms.

Thus, one advantage afforded is that of maximizing electromagnetic power transfer.

Another subject of the invention is a method for producing a monopole wire-plate antenna, including the steps of:

a) providing a substrate made of a magneto-dielectric material and which has first and second opposite planar surfaces;

b) forming a first interconnect hole through the substrate in order to obtain a supply probe;

c) forming a set of interconnect holes through the substrate, arranged in parallel around the first interconnect hole, in order to obtain a set of shorting wires;

d) forming a capacitive roof on the first surface of the substrate;

e) forming a ground plane on the second surface of the substrate; step e) being carried out such that the supply probe is electrically isolated from the ground plane.

Thus, such a method according to the invention makes it possible to produce a monopole wire-plate antenna easily on the basis of a substrate made of a magneto-dielectric material which coats both the supply probe and the set of shorting wires.

The term "interconnect hole" (also known as a "via") is understood to mean a metallized hole allowing an electrical connection to be established between two interconnect levels.

BRIEF DESCRIPTION OF THE DRAWINGS

Other features and advantages will become apparent in the detailed description of various embodiments of the invention, the description being accompanied by examples and references to the appended drawings.

Figure 1:
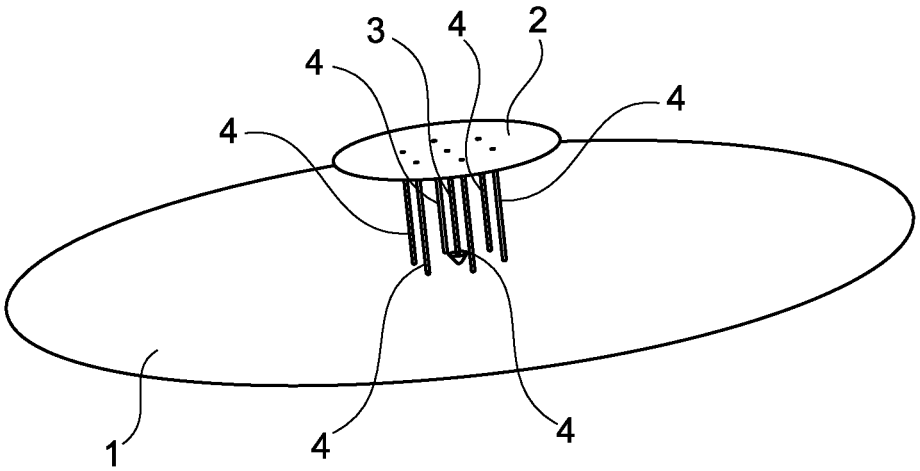
FIG. 1 is a schematic perspective view of a monopole wire-plate antenna illustrating a set of shorting wires arranged in parallel around the supply probe such that each shorting wire electrically connects the capacitive roof to the ground plane, the shorting wires not being coated with a magneto-dielectric material.

It should be noted that, for the sake of readability, the drawings described above are schematic and are not to scale.

DETAILED DISCLOSURE OF THE EMBODIMENTS

Elements that are identical or provide the same function will carry the same references for the various embodiments, for the sake of simplicity.

As illustrated in FIGS. 1 to 5, one subject of the invention is a monopole wire-plate antenna, including:

- a ground plane 1;
- a capacitive roof 2;
- a supply probe 3, which is electrically isolated from the ground plane 1 and runs between the ground plane 1 and the capacitive roof 2 so as to supply the capacitive roof 2 with electricity, the supply probe 3 being intended to be connected to a transmission line (not illustrated);
- a set of shorting wires 4, which are arranged in parallel around the supply probe 3 such that each shorting wire 4 electrically connects the capacitive roof 2 to the ground plane 1, each shorting wire 4 being coated with a magneto-dielectric material 5.

Ground Plane

Figure 2:
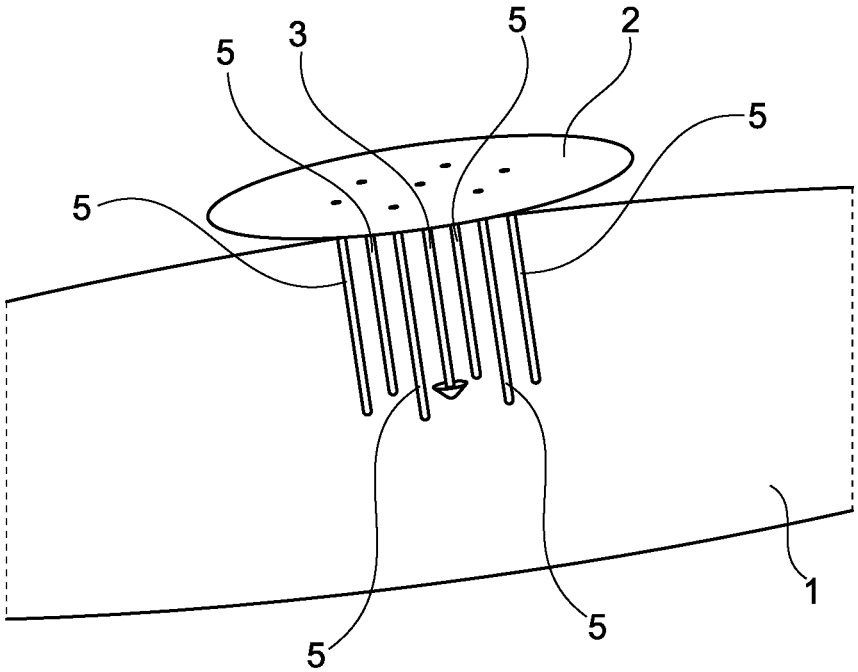
FIG. 2 is a schematic view analogous to that of FIG. 1 but enlarged, in which the shorting wires are coated with a magneto-dielectric material.

The ground plane 1 may be formed from a metal material, such as copper. The ground plane 1 may be circular in shape, as illustrated in FIGS. 1 and 2. However, other shapes may be contemplated for the ground plane 1, such as a rectangular (illustrated in FIGS. 3 to 5) or square shape.

The ground plane 1 may be formed on a dielectric substrate (not illustrated). An opening is made in the ground plane 1 (and optionally in the dielectric substrate) so as to allow the supply probe 3 to pass through.

It is possible for the ground plane 1 to be fitted with components, for example a direct-current (DC) circuit, a radiofrequency (RF) circuit or a supply cell, and to do so without negatively affecting the operation of the device.

Capacitive Roof

The capacitive roof 2 includes a planar electrically conductive, preferably metal, surface. The capacitive roof 2 is advantageously parallel to the ground plane 1. The term "parallel" is understood to mean within the typical tolerances of the experimental conditions under which the antenna elements are formed rather than perfect parallelism in the mathematical (geometric) sense of the term. However, the capacitive roof 2 may slope relative to the ground plane 1 when a capacitive effect is produced with the ground plane 1. The angle of inclination formed between the capacitive roof 2 and the ground plane 1 is preferably smaller than or equal to 30°.

The capacitive roof 2 thus produces a capacitive effect with the ground plane 1 allowing the resonant frequency of the antenna to be lowered, or the length of the monopole (i.e. the supply probe 1) to be decreased for a given resonant frequency.

The capacitive roof 2 is preferably circular in shape, for example with a radius of about $\lambda/11$, where $\lambda$ is the operating wavelength of the antenna. By way of non-limiting example, in the very-high-frequency (VHF) band at 135 MHz, the radius of the capacitive roof 2 is about 200 mm.

Other shapes may however be contemplated for the capacitive roof 2, such as a square, rectangular, elliptical or star shape.

Supply Probe

The supply probe 3 does not make contact with the ground plane 1 so as to be electrically isolated from the ground plane 1. By way of non-limiting example, the supply probe 3 may be joined to the ground plane 1 using a spacer (not illustrated) that is not electrically conductive.

The supply probe 3 advantageously runs perpendicular to the ground plane 1, and hence perpendicular to the capacitive roof 2, so as to avoid the radiation pattern of the antenna being disrupted by the ground plane 1. The supply probe 3 may be connected to a metal central core 30 of a coaxial waveguide. The supply probe 3 runs between the ground plane 1 and the capacitive roof 2, for example over a height of about $\lambda/11$, where $\lambda$ is the operating wavelength of the antenna. By way of non-limiting example, in the very-high-frequency (VHF) band at 135 MHz, the height of the supply probe 3 (between the ground plane 1 and the capacitive roof 2) is about 200 mm.

Figure 3:
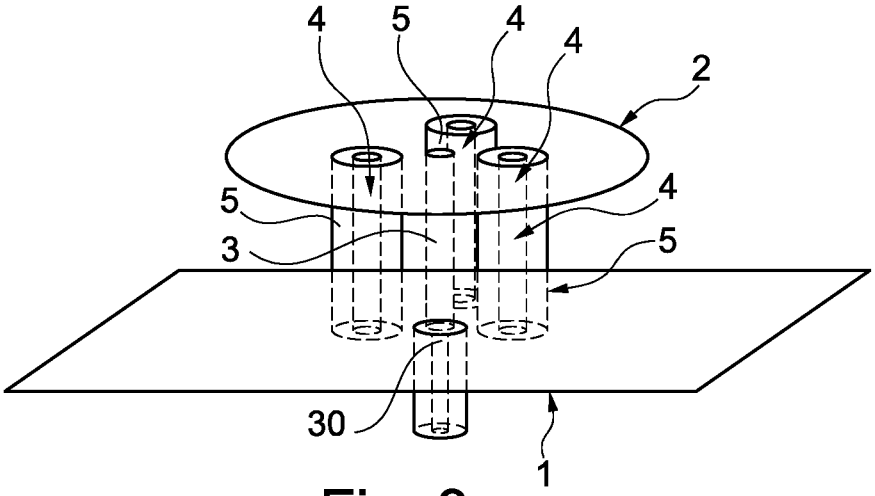
FIG. 3 is a schematic perspective view of an antenna according to the invention illustrating a first embodiment of the coating (individual coating of the shorting wires) with the magneto-dielectric material.
Figure 4:
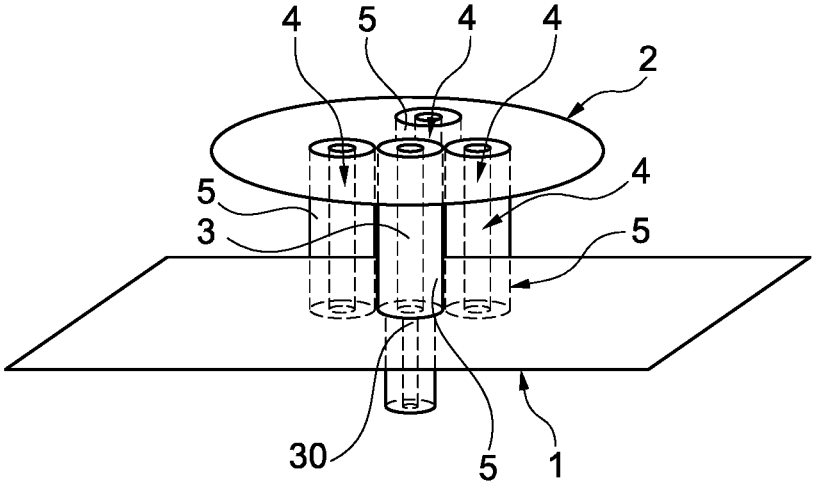
FIG. 4 is a schematic perspective view of an antenna according to the invention illustrating a second embodiment of the coating (individual coating of the shorting wires and of the supply probe) with the magneto-dielectric material.
Figure 5:
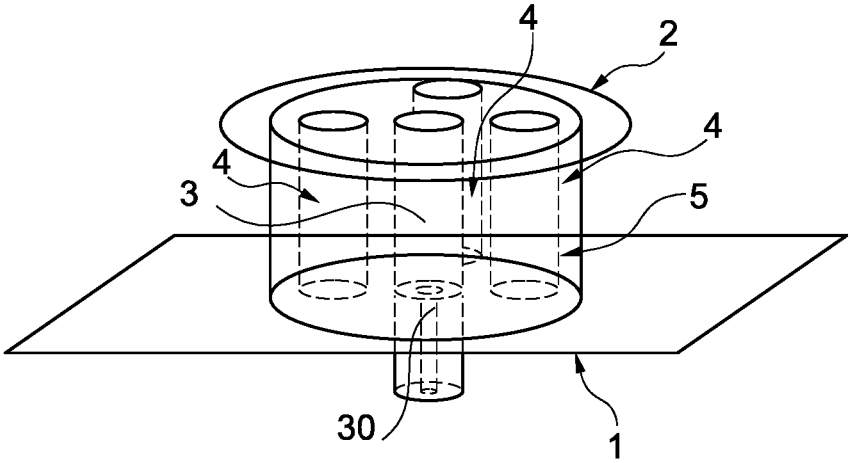
FIG. 5 is a schematic perspective view of an antenna according to the invention illustrating a third embodiment of the coating (collective coating of the shorting wires and of the supply probe) with the magneto-dielectric material.

The supply probe 3 is preferably arranged at the centre of the ground plane 1, as illustrated in FIGS. 1 to 5. The supply probe 3 is advantageously coated with the magneto-dielectric material 5, as illustrated in FIGS. 4 and 5.

The supply probe 3 is intended to be connected to a transmission line allowing the guided propagation of electromagnetic waves (e.g. in the radiofrequency range), the transmission line possibly being a coaxial supply cable or another waveguide.

Set of Shorting Wires

As illustrated in FIGS. 1 to 5, the set of, preferably metal, shorting wires 4 advantageously runs perpendicular to the ground plane 1, and hence perpendicular to the capacitive roof 2. The shorting wires 4 of the set are parallel to one another.

When the supply probe 3 is arranged at the centre of the ground plane 1, the set of shorting wires 4 advantageously includes at least one pair of shorting wires 4 that is arranged around the supply probe 3 with central symmetry. The set of shorting wires 4 includes a number (denoted by N) of shorting wires 4 chosen such that, for a given amount of magneto-dielectric material 5, the capacitive roof 2 and the supply probe 3 each have a maximum characteristic dimension such that the antenna is contained within a sphere with an electrical radius that is smaller than or equal to $\lambda/2\pi$, where $\lambda$ is the operating wavelength of the antenna.

If it is assumed that each shorting wire 4 has a radius, denoted by a, and each shorting wire 4 is separated by a distance, denoted by b, from the supply probe 3, the inventors have demonstrated that the set of shorting wires 4 is equivalent to a single wire having a radius (called the equivalent radius $R_{eq}$) that satisfies:

$$R_{eq}=(ab^{N-1})^{1/N}, N\in[\![1;6]\!]$$

The inventors postulate that this formula works regardless of the number of shorting wires 4 separated by a distance, denoted by b, from the supply probe 3, i.e. that the set of shorting wires 4 is equivalent to a single wire having an equivalent radius $R_{eq}$ that satisfies:

$$R_{eq}=(ab^{N-1})^{1/N}, N\in\mathbb{N}^*$$

The inventors have observed that for the same amount of magneto-dielectric material 5, arranging a set of N shorting wires 4 in parallel, each coated with a magneto-dielectric material 5, makes it possible to decrease the resonant frequency of the antenna towards the low frequencies by more than 30% in comparison with a single-shorting wire 4 coated with the magneto-dielectric material 5 and having an equivalent radius $R_{eq}$ calculated by the preceding formulas. In other words, arranging a set of N shorting wires 4 in parallel, each coated with a magneto-dielectric material 5, allows more efficient loading of the antenna with the magneto-dielectric material 5. For an architecture with a single shorting wire 4, it is estimated that a volume of magneto-dielectric material 20 times greater would be needed to decrease the resonant frequency of the antenna towards the low frequencies by more than 30%, which would result in substantial bulk, additional losses (due to the amount of additional material) and increased antenna weight.

By way of non-limiting examples, as illustrated in FIGS. 1 and 2, the set of shorting wires 4 may include three pairs of shorting wires 4 that are arranged around the supply probe 3 with central symmetry. Each shorting wire 4 may have a radius (a) of about 2.4 mm. Each pair of shorting wires 4 may be separated by a distance (b) of about 80 mm on either side of the supply probe 3 with central symmetry.

The shorting wires 4 are advantageously separated from the supply probe 3 by a distance chosen to match the input impedance of the antenna to 50 ohms.

As illustrated in FIGS. 3 to 5, it should be noted that the set of shorting wires 4 may include an odd number of shorting wires 4. However, this may result in asymmetry in the radiation of the antenna and give rise to cross-polarization.

Magneto-Dielectric Material

The magneto-dielectric material 5 is advantageously chosen such that the relationship $\mu_r > \varepsilon_r > 1$ is satisfied at the operating wavelength of the antenna, where:

$\mu_r$ is the relative permeability of the magneto-dielectric material 5;

$\varepsilon_r$ is the relative permittivity of the magneto-dielectric material 5.

The magneto-dielectric material 5 is advantageously chosen from $Ni_{0.5}Zn_{0.3}Co_{0.2}In_{0.075}Fe_{1.925}O_4$, $Ni_{0.76}Mn_{0.24-x}Co_xFe_2O_4$ where x is between 0 and 0.04, and $Ni_{0.61}Zn_{0.35}CO_{0.04}Fe_{1.98}O_4$.

As illustrated in FIG. 5, the antenna advantageously includes a magneto-dielectric layer 5 (formed of the magneto-dielectric material) extending between the ground plane 1 and the capacitive roof 2 so as to coat each shorting wire 4 and the supply probe 3. The capacitive roof 2 and the ground plane 1 define a cylindrical volume, and the magneto-dielectric layer 5 extends into all or part of the cylindrical volume.

As illustrated in FIGS. 3 and 4, the magneto-dielectric material 5 may also be produced in the form of a hollow cylinder within which a shorting wire 4 or the supply probe 3 runs.

Production Method

Figure 6:
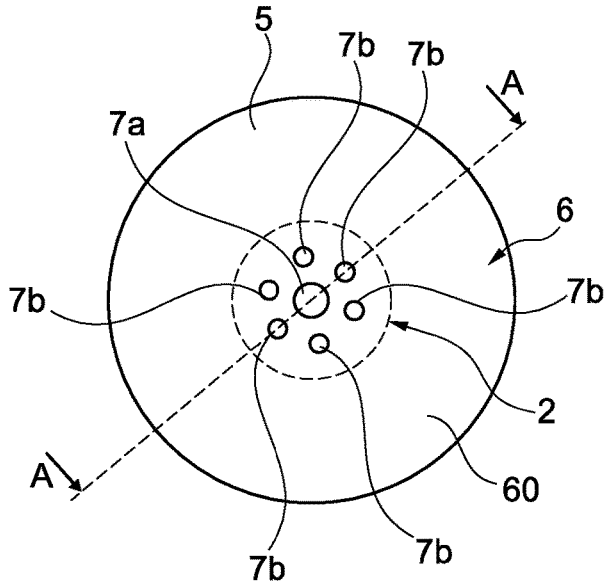
FIG. 6 is a schematic see-through view from above of a magneto-dielectric substrate in which interconnect holes are formed so as to obtain a monopole wire-plate antenna according to the invention.
Figure 7:
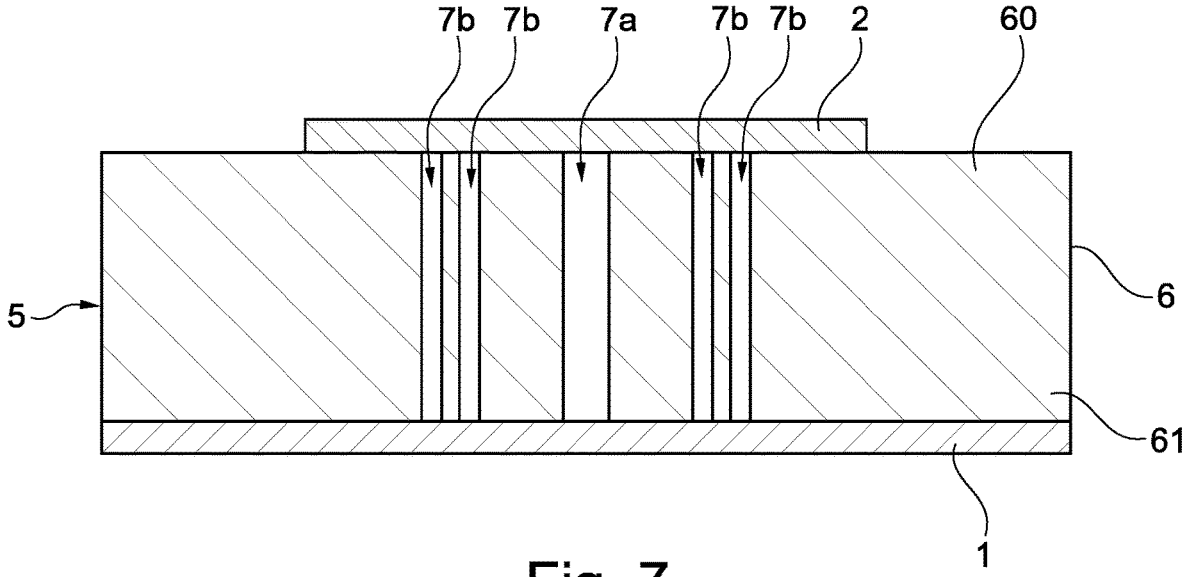
FIG. 7 is a schematic sectional view along the axis A-A through the magneto-dielectric substrate illustrated in FIG. 6.

As illustrated in FIGS. 6 to 7, another subject of the invention is a method for producing a monopole wire-plate antenna, including the steps of:

a) providing a substrate 6 made of a magneto-dielectric material 5 and which has first and second opposite planar surfaces 60, 61;

b) forming a first interconnect hole 7*a* through the substrate 6 in order to obtain a supply probe 3;

c) forming a set of interconnect holes 7*b* through the substrate 6, arranged in parallel around the first interconnect hole 7*a*, in order to obtain a set of shorting wires 4;

d) forming a capacitive roof 2 on the first surface 60 of the substrate 6;

e) forming a ground plane 1 on the second surface 61 of the substrate 6; step e) being carried out such that the supply probe 3 is electrically isolated from the ground plane 1.

The interconnect holes 7*a*, 7*b* may be metallized by sputtering.

Upon completion of step e), the set of shorting wires 4 and the supply probe 3 are coated with the magneto-dielectric material 5 of the substrate 6.

The invention is not limited to the described embodiments. A person skilled in the art is capable of considering technically feasible combinations thereof and of substituting them with equivalents.

The invention claimed is:

1. A monopole wire-plate antenna, comprising:

a ground plane;

a capacitive roof;

a supply probe, which is electrically isolated from the ground plane and runs between the ground plane and the capacitive roof so as to supply the capacitive roof with electricity, the supply probe configured to be connected to a transmission line;

a set of shorting wires, which are arranged in parallel around the supply probe such that each shorting wire electrically connects the capacitive roof to the ground plane, each shorting wire being coated with a magneto-dielectric material.

2. The antenna according to claim 1, wherein the supply probe is arranged at the centre of the ground plane and the set of shorting wires includes at least one pair of shorting wires that is arranged around the supply probe with central symmetry.

3. The antenna according to claim 2, wherein the set of shorting wires includes a number of shorting wires chosen such that, for a given amount of magneto-dielectric material, the capacitive roof and the supply probe each have a maximum characteristic dimension such that the antenna is contained within a sphere with an electrical radius that is smaller than or equal to $\lambda/2\pi$, where $\lambda$ is the operating wavelength of the antenna.

4. The antenna according to claim 2, wherein the supply probe is coated with the magneto-dielectric material.

5. The antenna according to claim 2, further comprising a magneto-dielectric layer extending between the ground plane and the capacitive roof so as to coat each shorting wire and the supply probe.

6. The antenna according to claim 1, further comprising a magneto-dielectric layer extending between the ground plane and the capacitive roof so as to coat each shorting wire and the supply probe.

7. The antenna according to claim 6, wherein the capacitive roof and the ground plane define a cylindrical volume, and the magneto-dielectric layer extends into all or part of the cylindrical volume.

8. The antenna according to claim 1, wherein the magneto-dielectric material is chosen from $Ni_{0.5}Zn_{0.3}Co_{0.2}In_{0.075}Fe_{1.925}O_4$, $Ni_{0.76}Mn_{0.24-x}Co_xFe_2O_4$ where x is between 0 and 0.04, and $Ni_{0.61}Zn_{0.35}CO_{0.04}Fe_{1.98}O_4$.

9. The antenna according to claim 1, wherein the shorting wires are separated from the supply probe by a distance chosen to match the input impedance of the antenna to 50 ohms.

10. The antenna according to claim 1, wherein the magneto-dielectric material is chosen such that the relationship $\mu_r > \varepsilon_r > 1$ is satisfied at the operating wavelength of the antenna, where:

$\mu_r$ is the relative permeability of the magneto-dielectric material;

$\varepsilon_r$ is the relative permittivity of the magneto-dielectric material.

11. The antenna according to claim 1, wherein the set of shorting wires includes a number of shorting wires chosen such that, for a given amount of magneto-dielectric material, the capacitive roof and the supply probe each have a maximum characteristic dimension such that the antenna is contained within a sphere with an electrical radius that is smaller than or equal to $\lambda/2\pi$, where $\lambda$ is the operating wavelength of the antenna.

12. The antenna according to claim 1, wherein the supply probe is coated with the magneto-dielectric material.

13. A method for producing a monopole wire-plate antenna, comprising the steps of:

a) providing a substrate made of a magneto-dielectric material and which has first and second opposite planar surfaces;

b) forming a first interconnect hole through the substrate in order to obtain a supply probe;

c) forming a set of interconnect holes through the substrate, arranged in parallel around the first interconnect hole in order to obtain a set of shorting wires;

d) forming a capacitive roof on the first surface of the substrate;

e) forming a ground plane on the second surface of the substrate; step e) being carried out such that the supply probe is electrically isolated from the ground plane.

* * * * *